United States Patent [19]

Cross et al.

[11] 3,990,695

[45] Nov. 9, 1976

[54] SORTING APPARATUS

[75] Inventors: Thomas R. Cross, Rochester; Clifford L. George, Macedon, both of N.Y.

[73] Assignee: Xerox Corporation, Stamford, Conn.

[22] Filed: Dec. 9, 1974

[21] Appl. No.: 530,904

[52] U.S. Cl. ..... 271/64

[51] Int. Cl.[2] ..... B65H 29/60

[58] Field of Search ..... 271/4, 64, 173; 270/58

[56] References Cited

UNITED STATES PATENTS

| | | | |
|---|---|---|---|
| 3,076,647 | 2/1963 | Lowe et al. | 271/173 |
| 3,774,906 | 11/1973 | Fagan et al. | 270/58 |
| 3,829,083 | 8/1974 | Shiina et al. | 271/4 |

*Primary Examiner*—Robert W. Saifer

[57] ABSTRACT

A sheet sorting apparatus having a main bin and a plurality of sorting bins. Multiple vertical transports advance copy sheets to the main bin or to the sorting bins according to the desired mode of operation. A horizontal transport advances the copy sheets onto one of two oppositely moving vertical transports via a pivotally mounted gate which is moved from a first position when in a sorting mode of operation into a second position when in a stacking mode of operation. At least one of the vertical transports is pivotally mounted to provide access to the sorting bins.

1 Claim, 2 Drawing Figures

SORTING APPARATUS

This invention relates in general to sheet sorting and stacking apparatus and in particular to a compact sorter for distributing copy sheets advanced from an electrostatographic printing machine.

Prior art sorters have encountered increasing demands in the sorting and stacking of copy sheets fed from high speed electrostatographic printing machines. Many of the prior art sorting devices are in the form of modules which are added onto the printing machine in sufficient numbers to accommodate the job requirements as described, for example, in U.S. Pat. Nos. 3,638,937, 3,774,906 and 3,802,694. While these prior art copying devices are satisfactory for handling a variety of job loads, they are not entirely suitable for compact spacing while enabling ease of access to sorter components to clear jams, etc.

It is an object of this invention to improve sorting apparatus used with copier/duplicator machines.

It is a further object of this invention to improve the production of collated copy sets printed by a copying machine.

It is another object of this invention to provide a compact bin arrangement for sorting or stacking copy sets.

It is another object of this invention to provide sorting apparatus easily accessible to clear jams.

These and other objects of the instant invention are achieved generally speaking by arranging diverse sheet transport paths to advance copy sheets to a stacking bin or to the sorting bins.

Figure 1:
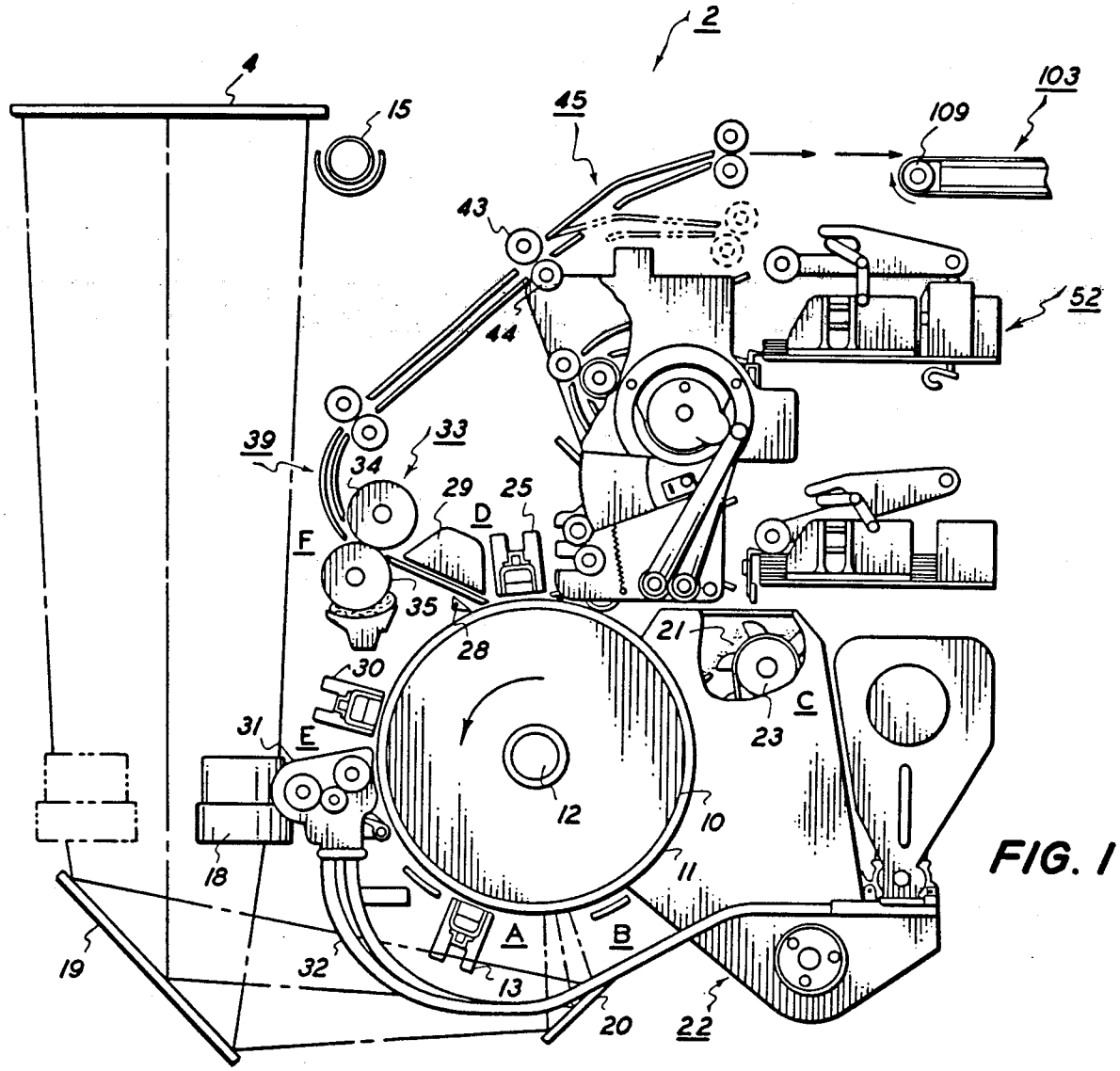
Figure 2:
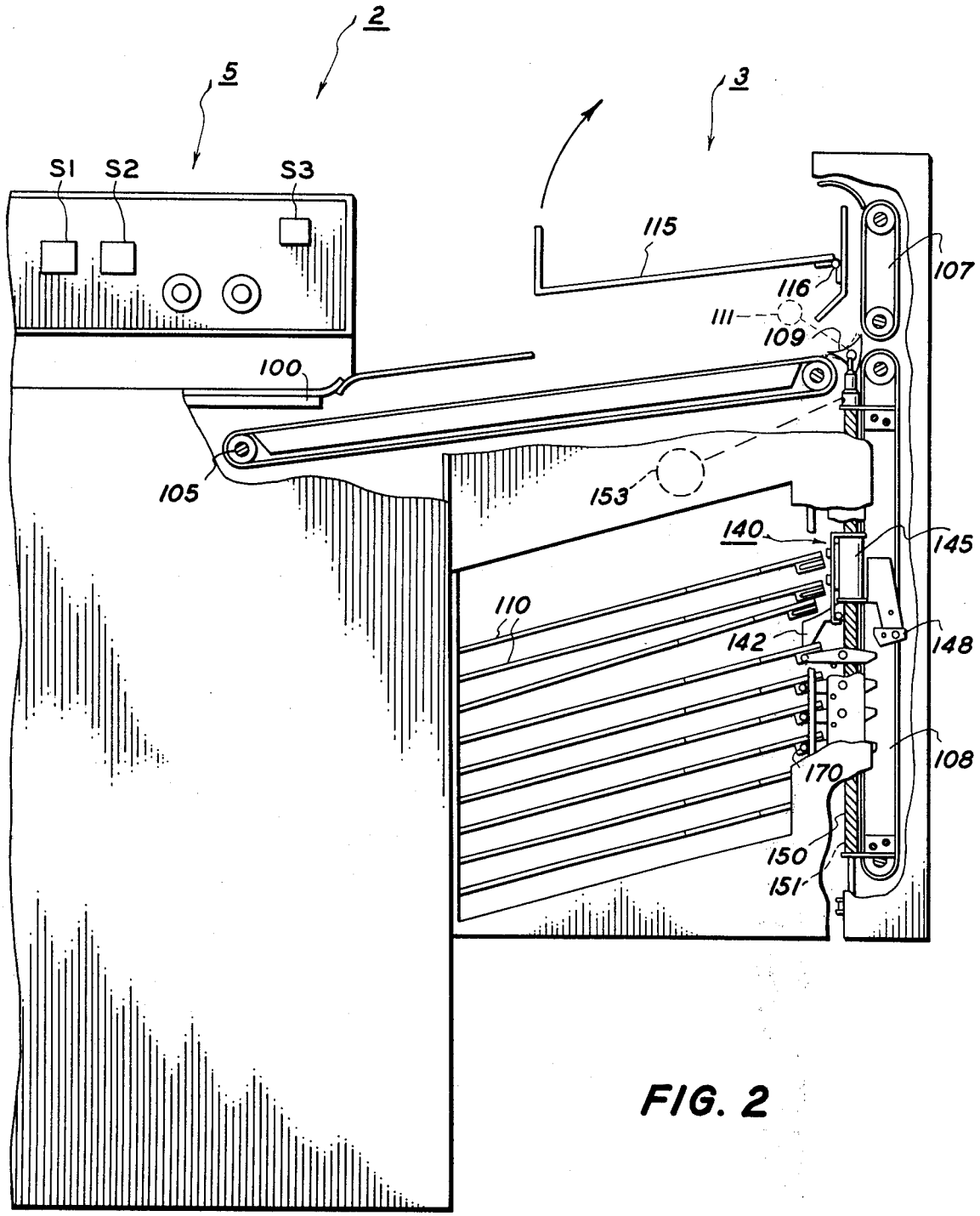

For a better understanding of the invention as well as other objects and further features thereof, reference is had to the following detailed description of the invention which is to be read in conjunction with the accompanying drawings wherein:

FIG. 1 illustrates schematically electrostatographic reproducing system including improved sorting apparatus in accordance with the instant invention; and FIG. 2 is a elevational view of sorting apparatus according to the invention.

FIG. 1 shows a schematic of the copier/duplicator system including a copier machine 2, which is a high speed copier/duplicator capable of producing simplex or duplex copies at the option of a machine operator. In accordance with the invention, the copier/duplicator system includes a sorting apparatus 3 as will be described more fully hereinafter. The copier machine 2 has a platen 4 for receiving documents to be reproduced, and a control panel 5 (FIG. 2) which includes various control knobs, buttons, and switches for selecting various modes of operation including a switch button S1 for START PRINT, S2 for sorter ON and S3 for sorter OFF.

The copier/duplicator system is an automatic xerographic apparatus which includes a photosensitive plate including a photoconductive layer 10 that is placed over a conductive backing. The plate is formed in the shape of a drum 11 and the drum mounted upon a shaft 12 that is journaled for rotation in the machine frame. Basically, the xerographic drum is rotated in the direction indicated so as to pass sequentially through a series of xerographic processing stations. The photosensitive drum and the xerographic processing apparatus are driven at predetermined speeds relative to each other from a drive system (not shown) and the operation thereof coordinated in order to produce proper cooperation of the various processing mechanism.

The original to be reproduced is placed upon a transparent horizontally supported platen 4 and the original scanned by means of a moving optical scanning system and to produce a flowing light image of the original. The scanning system includes an elongated horizontal extended aperture lamp 15 and a movable lens element 18.

The lamp and lens element move in coordination across the object supported upon the platen to focus successive incremental bans of illumination reflected from the object onto the moving drum surface at synchronous speeds therewith. The optical path is folded by means of a pair of image mirrors 19 and 20 interposed between the lens and the drum surface, the drum is first uniformly charged by means of a corona generator 13 positioned in charging station A. Under the influence of the flowing light image, the uniformly charged photocondictive surface is selectively dissipated in the non-image areas to form what is commonly known as a "latent electrostatic image."

The latent electrostatic image is carried on the drum surface from the exposure station into the developing station C. The developing station primarily is comprised of a developer housing 22 adapted to support a supply of twocomponent developer material 21 therein. The developer material is transported by means of a bucket system 23 from the bottom of the developer housing to an elevated position where the material is delivered into the active development zone. The developer material is caused to flow downwardly in contact with the upwardly moving drum surface under closely controlled conditions wherein charged toner particles are attracted from the developer mix into the image areas on the plate surface thus making the image visible.

The moving drum surface next transports the developed xerographic image to a transfer station D. Cut sheets of final support material are also moved into the transfer station, the backside of the copy sheet is sprayed with an ion discharge from a transfer corotron 25 inducing on the sheet a charge having a polarity and magnitude sufficient to attract the toner material from the drum surface to the final support material. This induced charge also electrostatically tacks the final support material to the drum surface. In order to remove the copy sheet from the drum surface, a stripper finger 28 is positioned downstream from the transfer corotron. The finger is arranged to move between the drum surface and the copy sheet and lifts the sheet from the drum surface and the copy sheet is directed along a predetermined path of travel into contact with a stationary vacuum transport 29.

Although a preponderance of the toner material is transferred from the drum surface to the copy sheet during the transfer process, invariably some residual toner remains behind on the drum surface after transfer. This residual toner is transported on the drum surface into a cleaning station E where it is brought under the influence of a cleaning corotron 30 adapted to neutralize the electrostatic charge tending to hold the residual toner to the drum surface. The neutralized toner is mechanically cleaned from the drum surface by means of a brush or the like and the toner collected within a housing 31. A conveyor moving in an endless loop through tubes 32 transports the collected residual toner back to the developer housing where it is deposited within the developer mix so that it can be once again reused in the xerographic developing process.

The copy sheet, which has been removed from the drum surface after the transfer operation is moved along stationary transport 29 into fusing station F. The fuser 33 is basically made up of an upper fuser roll 34 and a lower fuser roll 35 mounted in operative relation to each other and arranged to coact so as to support a sheet of material in pressure driving contact therebetween. The lower roll is heated. As the heated roll is rotated in the direction indicated, the heated surface of the lower roll is pressed into intimate contact with the image face of the support sheet. Mechanical and heat energy transported from the roll surface to the support sheet permanently bond the toner particles to the support material.

Upon leaving the fuser, the fixed copy sheet is passed through a curvalinear sheet guide system, generally referred to as 39, into cooperating advancing rolls 43 and 44. At this point, depending on the mode of operation selected, the copy sheet is either forwarded directly to the sorter or into the upper supply tray 52 by means of a movable sheet guide 45 before entering the sorter.

It is believed that the foregoing description is sufficient for purpose of the present application to show the general operation of a xerographic reproducing machine. For a more detailed explanation of the copier/-duplicator xerographic components reference is made to U.S. Pat. No. 3,645,615, entitled Copying Apparatus.

Referring now to FIG. 2, sorting apparatus 3 includes frame 100 housing a horizontal vacuum transport 105 which receives copy sheets from the copier machine and vertical vacuum transports 107 and 108. Interposed between the vertical transports is a pivotable gate 109 which is movable from one position as shown in dotted lines in FIG. 2-1 which directs the copy sheets onto transport 107 when operating in the non-sort mode of operation to another position which directs copies onto transport 108 when operating in the sort mode of operation. All of the transports have porous transport belts which are in communication with a source of vacuum provided by any suitable device such as a centrifugal blower (not shown).

In the non-sort mode of operation the copy sheets are advanced from the transport 107 into a main tray 115. Tray 115 is pivotally mounted to pivot on an axis 116 to provide access to horizontal transport 105. For the sort mode of operation the copy sheets are advanced from transport 108 into sorting bins 110. Bins 110 are closely spaced and are adapted to be raised into an opened position to enable a reliable feed-in of the copy sheets. The bins 110 are vertically positioned one above the other and are angled down and away from the transport 108 at an angle of approximately 15°. In this manner the copy sheets moving downward on the transport 108 are directed into each of the bins by a movable bin feeder and lifting device 140. Transports 107 and 108 are mounted on a section 101 of the frame 100 which is pivotable away from the bins 110 to provide access in the event of a jam.

Bin feeder and lifting device 140 includes a set of deflectors 142 which translate along the sheet path between the vertical extent of the bins. Deflectors 142 are secured to a carriage 145 which moves in a path along transport 108. Carriage 145 is driven by two helical screws 150 and 151 reversibly driven by a drive mechanism 153 to guide the carriage from the top bin to the bottom bin. The drive mechanism of the carriage provides the opposite direction motion for the reset of the carriage at the starting bin at the top. Bins 110 are pivotally mounted and rest on top of pins 170 so as to enable pivoting into an open feed-in position by fingers at the bin inlets activated by a cam 148 on the carriage as the copy sheet enters each of the bins.

In operation the sorting apparatus of the invention has two modes of operation. Upon depressing switch button S3 the sorter is off with all copies delivered to the main tray 115 with gate 109 positioned to direct the sheets onto transport 107. For the sorting mode of operation gate 109 is actuated to its other position by a solenoid 111 in a manner known by those skilled in the art by pressing switch button S2 and copy sheets exiting from the processor are directed onto transport 108. Copy sheets are advanced downwardly on transport 108 and are directed into bins 110 by the bin feeder and lifting device 140 which is stepped along the inlets of the bins 110. At the same time the bin is pivoted open and the copy sheet deflected therein. In the event that there is an excess number of copies for the bins or a jam the balance is automatically fed into tray 115 which also serves as an overflow tray by repositioning of gate 109 to its rest position due to de-energization of the actuating solenoid 111.

While there have been shown and described and pointed out the fundamental novel features of the invention as applied to a preferred embodiment it will be understood that various omissions and substitutions and changes in the form and details of the device illustrated and its operation may be made by those skilled in the art without departing from the spirit of the invention.

What is claimed is:

1. In a copying machine in which multiple copies of document information are produced, an improved sheet sorting apparatus for stacking or sorting copy sheets comprising:

a frame, a main tray secured to said frame, a vertical array of sorting bins secured to said frame vertically spaced from said main tray, first vertical transport means for transporting copy sheets to said main tray during a non-sort mode of operation, second vertical transport positioned adjacent to said first vertical transport means for transporting copy sheets to said plurality of bins during a sort mode of operation, substantially horizontal transport means for transporting copy sheets along a path directed towards the junction of said first and second vertical transport means and control means including gate means operable to direct sheets either to said first or second vertical transport means from said horizontal transport means depending upon the mode of operation of stacking or sorting selected by a machine operator, said gate means is positioned at the junction of first and second vertical transport means, said gate means being pivotally mounted from a first position directing copy sheets onto said first transport means to a second position directing copy sheets onto said second transport means when actuated by a solenoid in response to electrical signals, said main tray is pivotally mounted to enable access to the sheet path of said horizontal transport means.

* * * * *